United States Patent [19]

Mizutani et al.

[11] 4,097,397

[45] Jun. 27, 1978

[54] DRY CLEANING DETERGENT COMPOSITION

[75] Inventors: Hiroshi Mizutani, Yachiyo; Masaru Tamura, Sakura; Katsumi Saegusa, Funabashi, all of Japan

[73] Assignee: Kao Soap Co., Ltd., Tokyo, Japan

[21] Appl. No.: 809,524

[22] Filed: Jun. 24, 1977

[30] Foreign Application Priority Data

Oct. 27, 1976 Japan ..... 51-128966

[51] Int. Cl.[2] ..... C11D 3/26; C11D 7/32

[52] U.S. Cl. ..... 252/153; 8/142; 252/162; 252/171; 252/172; 252/545; 252/548; 252/557; 252/558

[58] Field of Search ..... 252/153, 545, 548, 557, 252/558, 162, 171, 172; 8/142

[56] References Cited

U.S. PATENT DOCUMENTS

| | | | |
|---|---|---|---|
| 3,057,676 | 10/1962 | Wedell | 8/142 |
| 3,630,935 | 12/1971 | Potter, Jr. | 8/142 X |
| 3,915,902 | 10/1975 | Ancel et al. | 252/153 |
| 3,926,862 | 12/1978 | Figiel et al. | 252/153 |

OTHER PUBLICATIONS

McCutcheon, "Detergent & Emulsifier," 1969, p. 37.

*Primary Examiner*—Mayer Weinblatt
*Attorney, Agent, or Firm*—Blanchard, Flynn, Theil, Boutell & Tanis

[57] ABSTRACT

A detergent composition for dry cleaning comprising from 10 to 30 percent by weight of an alkanolamine salt of a linear alkylbenzenesulfonic acid having 10 to 14 carbon atoms in the alkyl group, from 30 to 50 percent by weight of a dialkyl ester of sulfosuccinic acid having 8 to 9 carbon atoms in the alkyl group, from 2 to 20 percent by weight of an adduct of 1 to 7 moles of an alkylene oxide to a higher fatty acid alkanolamide, and the balance is essentially an organic solvent effective for dry cleaning.

11 Claims, 3 Drawing Figures

10 wt.% detergent solutions in tetrachloroethylene 1 wt.% detergent solution in tetrachloroethylene

DRY CLEANING DETERGENT COMPOSITION

BACKGROUND OF THE INVENTION

1. Field of the Invention

The present invention relates to a detergent composition for dry cleaning.

2. Description of the Prior Art

One of the roles of a detergent in dry cleaning compositions is the solubilization of water. The purposes of the solubilization of water are to permit water-soluble stains to be removed from the clothes by the water solubilized by the action of the detergent into the dry cleaning organic solvent (such as a petroleum type solvent or Perclene (tetrachloroethylene)) and to protect the clothes from shrinkage, deformation and color fading by water. Another purpose is to minimize the increase of the pressure of a filter for filtering the washing liquid by solubilizing the water introduced with the clothes into the washing bath. It is logical that the detergents to be used for attaining the foregoing purposes should have a high water solubility, namely, a capacity of solubilizing a large quantity of water in an organic solvent.

As the surface active agent in a detergent that is used for attaining the foregoing purposes, there can be mentioned anionic surface active agents such as petroleum sulfonates, dialkylsulfosuccinic acid esters, long chain alkylbenzenesulfonic acid salts, non-ionic surface active agents such as polyoxyethylene nonylphenyl ethers, fatty acid sorbitan esters, fatty acid alkylolamides and polyoxyethylene alkyl ethers, and amphoteric surface active agents such as imidazoline-type alkylbetaines.

Dry cleaning detergent compositions are composed of two or more of these surface active agents. However, no fully satisfactory combination has been developed as yet.

Linear alkylbenzenesulfonic acid salts are typical examples of detergent components used for attaining the foregoing objects, and those salts having a lower amine or a lower alkanolamine as the counter ion are especially frequently used. As the lower amine, there are employed propylamine, dibutylamine, butylamine and the like. However, these lower amines have a low boiling point and are easily volatile, and they are inflammable and have a high toxicity. Accordingly, use of these lower amines is not preferred in view of the process for preparing same and also in view of the resulting composition. Lower alkanolamine salts such as mono, di- and tri-ethanolamine salts and mono-, di- and tri-isopropanolamine salts have a good solubility in chlorinated hydrocarbon solvents (for example, Perclene) and they are widely used. However, because commercially available alkylbenzenesulfonic acids inevitably contain free sulfuric acid, such detergent compositions contain alkanolamine sulfates as an impurity. Since these salts are poorly soluble in an organic solvent, they readily precipitate in the detergent compositions. In general, the presence of such precipitates is unsatisfactory because they degrade the water-solubilizing property.

SUMMARY OF THE INVENTION

The present invention relates to an improved dry cleaning detergent composition comprising an alkanolamine salt of an alkylbenzenesulfonic acid. It is a primary object of the present invention to provide a composition which possesses an excellent water solubility. Another object of the present invention is to provide a composition that can be used in a wide temperature range.

The foregoing objects can be attained by a specific combination of surface active agents.

More specifically, in accordance with the present invention, there is provided a dry cleaning detergent composition comprising (A) from 10 to 30% (by weight; all references to "%" given hereinafter mean percent by weight) of an alkanolamine salt of a linear alkylbenzenesulfonic acid having 10 to 14 carbon atoms in the alkyl group, (B) from 30 to 50% of a dialkyl ester of sulfosuccinic acid having 8 to 9 carbon atoms in the alkyl group, (C) from 2 to 20% of an adduct of 1 to 7 moles of an alkylene oxide to a higher fatty acid alkanolamide and (D) the balance is essentially an organic solvent for dry cleaning.

The alkanolamine to be used for formation of the alkanolamine salt of the linear alkylbenzenesulfonic acid includes mono-, di- and tri-alkanolamines having 2 or 3 carbon atoms in the alkanol group. As specific examples of such alkanolamines, there can be mentioned monoethanolamine, diethanolamine, triethanolamine, monoisopropanolamine, diisopropanolamine and triisopropanolamine.

It is preferred that the amount of free sulfuric acid contained in the linear alkylbenzenesulfonic acid is less than 0.5%. A linear alkylbenzenesulfonic acid having a low free sulfuric acid content can be produced by a process comprising sulfonating an alkylbenzene with sulfuric anhydride ($SO_3$), immediately adding 2 to 7% by weight of a lower alkylbenzene having 1 to 4 carbon atoms in the alkyl group such as toluene, xylene, ethylbenzene or a mixture thereof, to the sulfonated product and reacting the lower alkylbenzene with the unreacted or excess sulfuric anhydride. In a linear alkylbenzenesulfonic acid obtained according to this process, the amount of free sulfuric acid is less than 0.5%.

The number of carbon atoms of the alkyl group of the dialkyl ester of sulfosuccinic acid is 8 or 9. As the alkyl groups, n-octyl and 2-ethylhexyl groups are preferred. Alkyl groups having a longer chain, such as N-decyl, isodecyl and dodecyl groups are not preferred because the higher alcohols are contained therein in considerable amounts, they have a high boiling point and they remain in the clothes after cleaning and give an unpleasant smell to the cleaned clothes. In the case of alkyl groups having a carbon number of 7 or less, the hydrophilic property is too high and the water solubility is reduced.

The higher fatty acid that is used as the starting material for preparing the alkylene oxide adduct of the higher fatty acid alkanolamide contains 10 to 18 carbon atoms, and higher fatty acids derived from natural fatty acids such as coconut oil, palm oil and beef tallow can be used or synthetic fatty acids having the above carbon number range can also be employed. The alkanolamine that is used for formation of the higher fatty acid alkanolamide includes mono- and di-alkanolamines having 2 or 3 carbon atoms in the alkanol group. As specific examples of the alkanolamine, there can be mentioned monoalkanolamines such as monoethanolamine and monoisopropanolamine and dialkanolamines such as diethanolamine and diisopropanol amine. Monoethanolamine is especially preferred. The alkylene oxide to be added is an alkylene oxide having 2 or 3 carbon atoms and it includes ethylene oxide and propylene oxide. Ethylene oxide is especially preferred. The mole number of the added alkylene oxide units is 1 to 7, preferably 2 to 5.

O: monoisopropanolamine salt of (A)

X: diisopropanolamine salt of (A)

Figure 2:
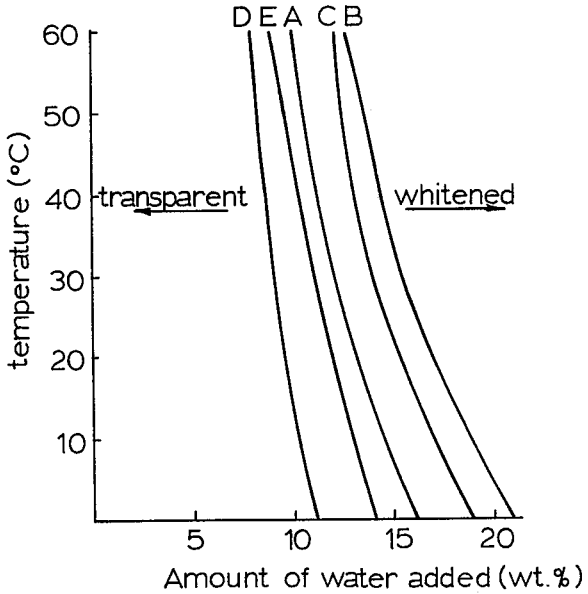

FIG. 2 is a graph illustrating the solubilization limit curves of 10% detergent solutions in Perclene. The water-solubilization range, in which transparent solutions exist, is on the left side of each curve, whereas the solutions are white turbid to the right of the respective curves. Curves A, B, C, D and E show the results obtained with respect to detergents A, B, C, D and E of Example 1, respectively.

Figure 3:
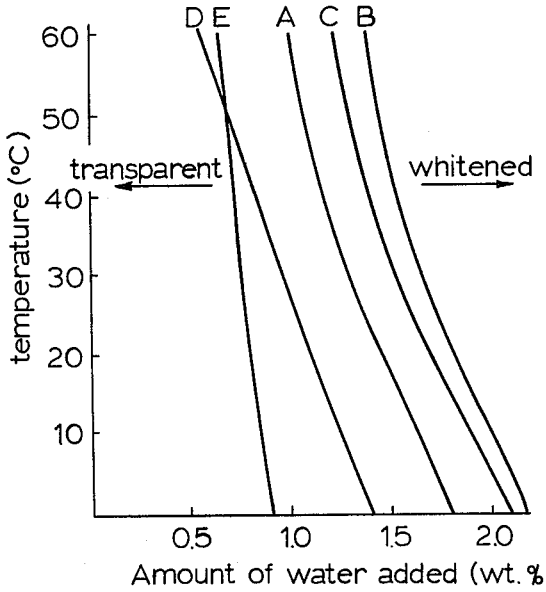

FIG. 3 is a graph illustrating the solubilization limit curves of 1% detergent solutions in Perclene. The water-solubilization range is on the left side of each curve. Curves A, B, C, D and E show the results obtained with respect to detergents A, B, C, D and E of Example 1, respectively.

Figure 1:
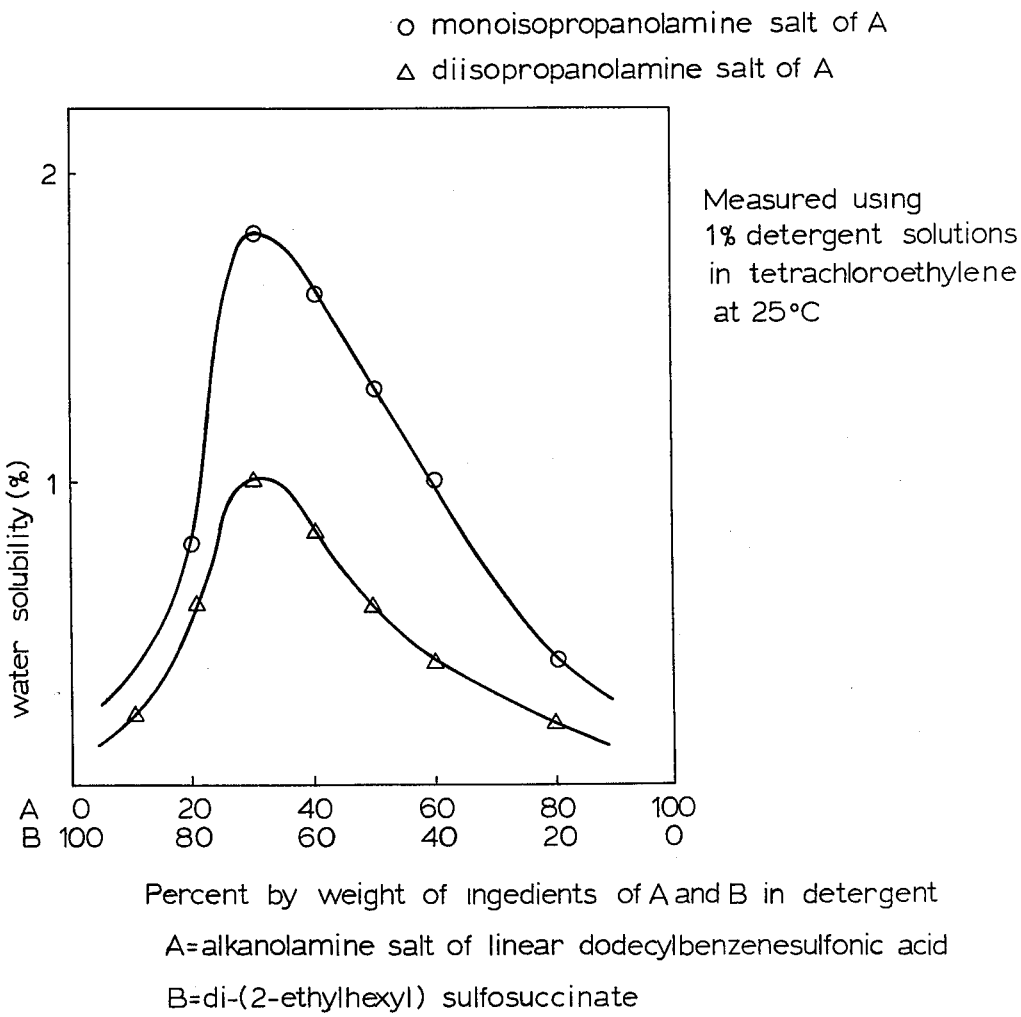
FIG. 1 is a graph illustrating the solubility of water in a two-component system comprising (A) an alkanolamine salt of linear dodecylbenzenesulfonic acid and (B) di-(2-ethylhexyl) sulfosuccinate. The measurement was conducted at 25° C by using a 1% detergent solution in Perclene.

As is seen from the results shown in FIG. 1, the alkanolamine salt of the linear alkylbenzenesulfonic acid (A) and the dialkyl ester of sulfosuccinic acid (B) have a prominent synergistic effect with respect to the water solubility. The mixing ratio of (A) the alkanolamine salt of the linear alkylbenzenesulfonic acid to (B) the dialkyl ester of sulfosuccinic acid, namely the ratio (A)/(B), according to the invention, is in the range of from 15/85 to 50/50, preferably from 20/80 to 40/60.

A two-component system comprising the alkanolamine salt of the linear alkylbenzenesulfonic acid and the dialkyl ester of sulfosuccinic acid is excellent in solubility of water therein, but at low temperatures the water solubility is degraded and the system becomes turbid. It was found that the addition of the alkylene oxide adduct of the higher fatty acid alkanolamide is effective for preventing the system from becoming turbid at low temperatures. This effect, however, is reduced if the sulfuric acid content in the linear alkylbenzenesulfonic acid is higher than 0.5%. Accordingly, it is preferred that the content of sulfuric acid be lower than 0.5%. It may be expected that other non-ionic surface active agents will attain a similar effect, but they simultaneously reduce the water solubility or increase the viscosity of the resulting composition or cause gelation thereof. This tendency is especially remarkable when water is incorporated. Therefore, the use of these non-ionic surface active agents is not preferred.

The amounts of the critical components are (A) from 10 to 30%, preferably 15 to 20%, of the alkanolamine salt of the linear alkylbenzenesulfonic acid, (B) from 30 to 50%, preferably 35 to 45%, of the dialkyl ester of sulfosuccinic acid, (C) from 2 to 20%, preferably 5 to 15%, of the alkylene oxide adduct of the higher fatty acid alkanolamide, and (D) the balance is, preferably 20 to 45 percent by weight, essentially an organic solvent for dry cleaning.

In addition to the foregoing critical components, the detergent composition of the present invention may further contain various conventional components of dry cleaning compositions. For example, anionic surface active agents such as petroleum sulphonates and non-ionic surface active agents such as polyoxyethylene alkylphenyl ethers, polyoxyethylene alkyl ethers and fatty acid sorbitan esters may be incorporated. Lower alkyl glycol ethers in an amount of 0.5 to 6% by weight based on the total weight of the composition may be used as auxiliary hydrophilic solvents for enhancing the water solubilizing rate and adjusting the HLB value of the detergent. As such lower alkyl glycol ether, there can be mentioned, for example, ethylene glycol monoalkyl ethers or diethylene glycol monoalkyl ethers having 1 to 4 carbon atoms in the alkyl group, that is ethyl Cellosolve, ethyl Carbitol, butyl Cellosolve, butyl Carbitol, propyl Carbitol, propyl Cellosolve, isobutyl Carbitol and isobutyl Cellosolve. As other auxiliary components, there may be appropriately used fluorescent dyes, perfumes and water.

Organic solvents for dry cleaning to be used in this invention include petroleum solvents such as benzine and mineral spirit and perclene-type solvents such as perchloroethylene, trichloroethane and carbon tetrachloride.

The present invention will now be described by reference to the following illustrative Examples.

EXAMPLE 1

Various dry cleaning detergent compositions were prepared and they were tested with respect to the water solubility of water therein and the washing power.

WATER SOLUBILITY TESTS (1) Ten cc of a 1% detergent solution (in Perclene) was charged in a glass test tuge and water was added in small amounts to the detergent solution with a micro syringe, and the mixture was shaken and the turbidity of the liquid was observed. This procedure was repeated until the liquid became turbid, and the amount of water added just before the liquid became turbid was defined as the solubilized amount.

(2) Ten cc of a 10% detergent solution (in Perclene) was charged in a glass test tube and water was added dropwise with a buret, and change of the transparency of the liquid was observed under shaking. The amount of water added just before the liquid became turbid was defined as the solubilized amount.

DETERGENCY TEST

A soiled cloth (5 cm × 10 cm) made by dipping a piece of cloth in soy sauce was washed by a 1% detergent solution (in Perclene) at 25° C for 10 minutes in a Launder-O-Meter. Rinsing was omitted. The detergency was determined from reflectivities of the soiled cloth before and after washing.

The results obtained are shown in Table 1.

| | |
|---|---|
| Composition A | |
| Monoethanolamine salt of linear dodecylbenzenesulfonic acid | 17% |
| Di-(2-ethylhexyl) sulfosuccinate | 37% |
| Adduct of ethylene oxide (2 moles) to lauryl monoethanolamide | 7% |
| Butyl Cellosolve | 2% |
| Water | 3% |
| Perclene | 34% |
| Composition B | |
| Monoisopropanolamine salt of linear dodecylbenzenesulfonic acid | 23% |
| Di-(n-octyl) sulfosuccinate | 43% |
| Adduct of ethylene oxide (5 moles) to oleyl monoethanolamide | 13% |
| Isopropyl Cellosolve | 2% |
| Water | 5% |
| Perclene | 24% |

-continued

| Composition C | |
|---|---|
| Diisopropanolamine salt of linear dodecylbenzenesulfonic acid | 20% |
| Di-(2-ethylhexyl) sulfosuccinate | 40% |
| Adduct of ethylene oxide (3 moles) to coconut fatty acid monoethanolamide | 10% |
| Butyl Carbitol | 3% |
| Water | 3% |
| Perclene | 24% |

Table 1

| Composition | Amount of Solubilized Water (maximum %) (as measured at 25° C) 1% solution | 10% solution | Detergency | Temperature Dependency | Remarks |
|---|---|---|---|---|---|
| A | 1.4 | 12.0 | 85 | as shown in FIGS. 2 and 3 | present invention |
| B | 1.7 | 16.1 | 92 | " | " |
| C | 1.6 | 14.5 | 90 | " | " |
| Commercially Available Product D* | 1.0 | 9.0 | 78 | " | comparison |
| Commercially Available Product E** | 0.8 | 11.0 | 72 | " | " |

*commercially available product D comprises as main components potassium branched alkylbenzenesulfonate, polyoxyethylene nonylphenyl ether and lauryl diethanolamide.
**commercially available product E comprises as main components potassium petroleum sulfonate, di-(2-ethylhexyl) sulfosuccinate and polyoxyethylene nonylphenyl ether.

EXAMPLE 2

In the composition A of Example 1, the adduct of ethylene oxide (2 moles) to lauryl monoethanolamide was replaced by the various non-ionic surface active agents listed in Table 2, and the temperature ranges of water-solubilizing of the resulting compositions were determined. More specifically, the temperature of a liquid mixture comprising 10 parts of Perclene, 1 part of the sample composition and 1 part of water was changed and the range of temperatures in which the liquid mixture remained transparent was determined. The results obtained are shown in Table 2.

Table 2

| Non-Ionic Surface Active Agent | Range of Water-Solubilizing Temperatures (° C) |
|---|---|
| not added | 28 to 60 |
| coconut fatty acid monoethanolamide | 20 to 60 |
| coconut fatty acid diethanolamide | 15 to 50 |
| lauryl monoethanolamide | 23 to 55 |
| lauryl diethanolamide | 16 to 47 |
| oleyl monoethanolamide | 15 to 50 |
| oleyl diethanolamide | 10 to 55 |
| adduct of 2 moles of ethylene oxide to coconut fatty acid monoethanolamide | below 0 to 60 |
| adduct of 5 moles of ethylene oxide to coconut fatty acid monoethanolamide | below 0 to 55 |
| adduct of 10 moles of ethylene oxide to coconut fatty acid monoethanolamide | below 0 to 30 |
| adduct of 2 moles of ethylene oxide to lauryl monoethanolamide | below 0 to 55 |
| adduct of 5 moles of ethylene oxide to lauryl monoethanolamide | below 0 to 50 |
| adduct of 10 moles of ethylene oxide to lauryl monoethanolamide | below 0 to 28 |
| adduct of 2 moles of ethylene oxide to oleyl monoethanolamide | below 0 to 65 |
| adduct of 5 moles of ethylene oxide to oleyl monoethanolamide | below 0 to 60 |
| adduct of 10 moles of ethylene oxide to oleyl monoethanolamide | below 0 to 35 |
| polyoxyethylene (3 moles) nonylphenyl ether | 25 to 48 |
| polyoxyethylene (6 moles) nonylphenyl ether | 20 to 40 |
| polyoxyethylene (9 moles) nonylphenyl ether | 12 to 35 |
| polyoxyethylene (12 moles) nonylphenyl ether | 0 to 20 |
| polyoxyethylene (3 moles) oleyl ether | 20 to 45 |

Table 2-continued

| Non-Ionic Surface Active Agent | Range of Water-Solubilizing Temperatures (° C) |
|---|---|
| polyoxyethylene (6 moles) oleyl ether | 14 to 40 |
| polyoxyethylene (9 moles) oleyl ether | 10 to 38 |

EXAMPLE 3

In the composition A of Example 1, the relation between the amount of free sulfuric acid in the linear dodecylbenzenesulfonic acid and the water-solubilizing temperature range was examined. The experimental method was the same as that employed in Example 2. The results obtained are shown in Table 3.

Table 3

| Amount (%) of Free Sulfuric Acid | Stability (at room temperature) of Liquid Detergent Mixture | Range of Water-Solubilizing Temperature (° C) |
|---|---|---|
| 0.1 | | below 0 to 60 |
| 0.3 | | below 0 to 60 |
| 0.5 | | below 0 to 59 |
| 0.7 | Δ | 10 to 60 |
| 1.0 | Δ | 15 to 60 |
| 1.5 | X | 20 to 60 |
| 2.0 | X | 28 to 55 |
| 2.5 | X | 33 to 52 |
| 3.0 | X | 40 to 52 |

means completely stable
Δ means poor stability
X means unstable

The embodiments of the invention in which an exclusive property or privilege is claimed are defined as follows:

1. A dry cleaning detergent composition consisting essentially of (A) from 10 to 30 percent by weight of an alkanolamine salt of a linear alkylbenzenesulfonic acid having 10 to 14 carbon atoms in the alkyl group and wherein said alkanolamine is a monoalkanolamine, dialkanolamine or trialkanolamine having 2 or 3 carbon atoms in the alkanol group, (B) from 30 to 50 percent by weight of a dialkyl ester of sulfosuccinic acid having 8 or 9 carbon atoms in the alkyl group, (C) from 2 to 20 percent by weight of an adduct of 1 to 7 moles of an alkylene oxide having 2 or 3 carbon atoms to a higher fatty acid alkanolamide prepared from a fatty acid having from 10 to 18 carbon atoms and a monoalkanolamine or dialkanolamine having 2 or 3 carbon atoms in the alkanol group, and (D) the balance is essentially an organic dry cleaning solvent.

2. A dry cleaning detergent composition according to claim 1 wherein the amount of free sulfuric acid in the linear alkylbenzenesulfonic acid is less than 0.5 percent by weight.

3. A dry cleaning detergent composition according to claim 1 wherein the alkyl of the dialkyl ester of sulfosuccinic acid is n-octyl or 2-ethylhexyl.

4. A dry cleaning detergent composition according to claim 1 in which the number of moles of said alkylene oxide added to the higher fatty acid alkanolamide is from 2 to 5.

5. A dry cleaning detergent composition according to claim 1 wherein the higher fatty acid alkanolamide is a monoethanolamide of a higher fatty acid having 10 to 18 carbon atoms.

6. A dry cleaning detergent composition according to claim 5 wherein the alkylene oxide is ethylene oxide.

7. A dry cleaning detergent composition according to claim 1 in which the weight ratio of A/B is from 15/85 to 50/50.

8. A dry cleaning detergent composition according to claim 7 in which the amount of A is from 15 to 20 percent by weight, the amount of B is from 35 to 45 percent by weight, the amount of C is from 5 to 15 percent by weight and the amount of D is from 20 to 45 percent by weight.

9. A dry cleaning detergent composition according to claim 1 in which said organic solvent is selected from the group consisting of benzine, mineral spirit, perchloroethylene, trichloroethane and carbon tetrachloride.

10. A dry cleaning detergent composition consisting essentially of (A) from 10 to 30 percent by weight of an alkanolamine salt of a linear alkylbenzenesulfonic acid having 10 to 14 carbon atoms in the alkyl group and wherein said alkanolamine is a monoalkanolamine, dialkanolamine or trialkanolamine having 2 or 3 carbon atoms in the alkanol group, (B) from 30 to 50 percent by weight of a dialkyl ester of sulfosuccinic acid having 8 to 9 carbon atoms in the alkyl group, (C) from 2 to 20 percent by weight of an adduct of 1 to 7 moles of an alkylene oxide having 2 or 3 carbon atoms to a higher fatty acid alkanolamide prepared from a fatty acid having from 10 to 18 carbon atoms and a monoalkanolamine or dialkanolamine having 2 or 3 carbon atoms in the alkanol group, (D) from 0.5 to 6 percent by weight of a substance selected from the group consisting of ethylene glycol monoalkyl ethers and diethylene glycol monoalkyl ethers having 1 to 4 carbon atoms in the alkyl group and (E) the balance is essentially an organic dry cleaning solvent.

11. A dry cleaning detergent composition according to claim 10 in which said organic solvent is selected from the group consisting of benzine, mineral spirit, perchloroethylene, trichloroethane and carbon tetrachloride.

* * * * *